US005785517A

United States Patent [19]

Gray et al.

[11] Patent Number: 5,785,517

[45] Date of Patent: Jul. 28, 1998

[54] COOLING ARRANGEMENTS FOR REFRACTORY WALL LININGS

[75] Inventors: Neil Boon Gray, North Balwyn; Jonathan Alan Harris, Townsville; Anthony Regnar Leggett, East Brunswick; Barry John Elliott, Kalgoorlie, all of Australia

[73] Assignees: The University of Melbourne; WMC Resources Ltd., both of Australia

[21] Appl. No.: 693,153

[22] PCT Filed: Feb. 16, 1995

[86] PCT No.: PCT/AU95/00074

§ 371 Date: Nov. 14, 1996

§ 102(e) Date: Nov. 14, 1996

[87] PCT Pub. No.: WO95/22732

PCT Pub. Date: Aug. 24, 1995

[30] Foreign Application Priority Data

Feb. 16, 1994 [AU] Australia ..... PM 3930

[51] Int. Cl.[6] ..... F27D 1/12

[52] U.S. Cl. ..... 432/252; 110/336; 110/338; 110/340

[58] Field of Search ..... 432/247, 248, 432/251, 252; 110/336, 338, 340; 264/30

[56] References Cited

U.S. PATENT DOCUMENTS

| | | | |
|---|---|---|---|
| 1,724,098 | 8/1929 | McKenzie et al. . | |
| 2,686,666 | 8/1954 | Tau | 266/32 |
| 3,204,937 | 9/1965 | Crespi | 264/30 |
| 3,849,587 | 11/1974 | Hatch et al. | 13/32 |
| 4,024,903 | 5/1977 | Yamada et al. . | |
| 4,097,679 | 6/1978 | Fukumoto et al. . | |
| 4,221,922 | 9/1980 | Okimune . | |
| 4,619,441 | 10/1986 | Felthuis et al. | 266/193 |
| 4,768,447 | 9/1988 | Roumeguere | 110/338 |
| 5,058,534 | 10/1991 | Pohl et al. | 122/6 A |

FOREIGN PATENT DOCUMENTS

| | | |
|---|---|---|
| 556212 | 4/1957 | Belgium . |
| 12132 | 6/1980 | European Pat. Off. . |
| 1944415 | 4/1971 | Germany . |
| 1585155 | 2/1981 | United Kingdom . |
| 90/05886 | 4/1990 | WIPO . |

OTHER PUBLICATIONS

Patent Abstracts of Japan, JP 59–16915, vol. 8, No.102, May 12, 1984.

Patent Abstracts of Japan, JP 3–70986, Mar. 3, 1991.

Patent Abstracts of Japan, JP 5–9542, Jan. 19, 1993.

*Primary Examiner*—Henry A. Bennett
*Assistant Examiner*—Gregory Wilson
*Attorney, Agent, or Firm*—Andrus, Sceales, Starke & Sawall

[57] ABSTRACT

A wall lining for a furnace (10) includes a refractory layer (14) having a hot face (16) exposed to the interior of the furnace. A plurality of elements of a high thermal conductivity material (18), such as copper wires or rods, extend from the outer shell (12) of the furnace into the refractory lining (14). The elements (18) provide a continuous heat conduction path to the outer shell (12) of the furnace. A cooling jacket (22) removes heat from the outer shell. The elements (18) are dispersed in the refractory lining (14) to provide a substantially uniform temperature across the hot face of the furnace in the vicinity of the elements. The wall lining may be formed by fixing an array of the elements to the inside wall of the outer shell of the furnace and applying a refractory material to the inside wall.

20 Claims, 4 Drawing Sheets

COOLING ARRANGEMENTS FOR REFRACTORY WALL LININGS

CROSS REFERENCE TO RELATED APPLICATION

The present application comprises the U.S. national stage application of international application PCT/AU95/00074 designating the United States and having an international filing date of Feb. 16, 1995, which application, in turn, claims the priority of Australian application PM 3930, filed Feb. 16, 1994.

BACKGROUND OF THE INVENTION

The present invention relates to refractory wall linings used in furnaces. In particular, the present invention relates to cooling arrangements for refractory wall linings.

Furnaces operating at high temperatures are used in a number of different processes, including the smelting of metals. Most furnaces are constructed from an outer shell made of a metallic material, which is usually steel. The outer shell is lined with a layer of refractory bricks to insulate the outer shell from the extreme temperatures in the interior of the furnace and also to prevent the very hot materials contained in the furnace from contacting the outer shell. Refractory linings should have a long life in order to minimise the considerable down time associated with relining a furnace.

Refractory linings are generally made from materials that are fairly unreactive with the contents of the furnace. However, erosion and destruction of refractory linings does occur and it has been found that the rate of erosion and destruction of the lining increases as the temperature of the hot face of the lining (that is, the face of the lining exposed to the interior of the furnace) increases. Therefore, numerous attempts have been made to decrease the temperature of the hot face of the lining in order to increase the life of the refractory lining.

One construction proposed for use in decreasing the temperature of the hot face involves the installation of a water-cooling circuit in the refractory lining. As water flows through the cooling circuit, it extracts heat from the refractory lining and acts to decrease the temperature of the hot face of the lining. Although such constructions operate to satisfactorily reduce the temperature of the lining, they involve the use of cooling water circuits within the lining. Any leakage of water from the cooling circuit has the potential to seep into the furnace and cause explosions and hydration of the refractory. This is obviously an extremely hazardous situation and it is now believed that internal water-cooling of refractory linings should be avoided.

Another approach that has been adopted by industry involves the placement of solid cooling members of high thermal conductivity through the wall of a furnace and into a lining. The outer portion of the solid cooling members remain outside the refractory lining. The portions of the cooling members located external to the furnace are cooled by a water cooling circuit. Accordingly, if leaks develop in the water-cooling circuit, water cannot come into contact with the hot contents of the furnace, which eliminates hydration and reduces the danger of explosion. The solid cooling members are generally spaced about half a meter apart from each other. This leads to large temperature gradients in the refractory lining. Areas of high temperature in the lining wear much more quickly than areas of relatively lower temperature and wear of the lining is very uneven. Furthermore, the large temperature gradients in the lining set up large thermal stresses in the refractory lining.

United Kingdom Patent No. 1,585,155 describes an arc-furnace that is provided with a composite lining that includes an exposed inner layer of refractory material facing the furnace interior. An outer layer of refractory material that backs onto the inner layer is provided, with this outer layer of refractory material being in thermal contact with the inner layer. The outer layer is made of a material that has a higher thermal conductivity than the inner layer. The outer layer may be in contact with the furnace casing, which dissipates heat to the surroundings or, more usually, to a forced air or water-cooling medium. The composite construction of the refractory lining acts to increase the heat flow through the side wall lining to thereby reduce the extent of refractory wear. This construction suffers from the disadvantage of requiring a composite refractory wall structure to be installed in the furnace. Furthermore, although the outer layer of the refractory lining is described as being made from a high conductivity refractory material, the conductivity of such refractory materials is relatively low and this acts to somewhat limit the amount of heat that can be removed from the furnace. Composite linings are also expensive and may be reactive.

A further solution to the erosion and penetration of refractory linings in high temperature furnaces is described in U.S. Pat. No. 3,849,587, assigned to Hatch Associates Limited. This patent discloses protecting refractory linings of furnaces operating a high temperature by placing solid cooling members of high thermal conductivity through the wall of a furnace and into the lining. The outer portions of the solid cooling members remain outside the refractory lining. The cooling members embedded in the lining are substantially devoid of water-cooled channels in the portions located in the lining of the furnace which avoids water leaks into the furnace. The portions of the cooling members located outside the furnace are generally cooled by a water-cooling circuit. The length, cross-sectional area, spacing and a material of the cooling members are selected to avoid melting of the cooling members and to conduct sufficient heat from the lining to limit erosion of the lining.

The cooling members inserted in the lining are preferably made from copper. The cooling members described in this patent are of a large diameter, typically of about four inches (100 mm) diameter, and are spaced a relatively large distance apart from each other. This leads to the formation of a temperature gradient across the hot face of the refractory lining, with the attendant uneven wear and thermal stresses associated with such temperature gradients.

SUMMARY OF THE INVENTION

The present invention provides a refractory lining that overcomes or at least ameliorates one or more of the disadvantages of the above prior art.

In a first aspect, the present invention provides a wall lining for a furnace having an outer shell and a source of external coolant in conjunction with the outer shell, said wall lining comprising a refractory lining adjacent the outer shell, the refractory lining having a hot face exposed to high temperature during operation of the furnace, the refractory lining including a plurality of elements of a high thermal conductivity material, the elements extending into the refractory lining towards the hot face, each of the elements providing a continuous heat conduction path from the end of the element located closer to the hot face to the outer shell of the furnace, the plurality of elements being dispersed and spaced in the refractory lining to provide a substantially uniform temperature across the hot face of the furnace in the vicinity of the elements during operation of the furnace.

By "substantially uniform temperature", it is meant that the temperature across the hot face does not vary by more than 100° C. Preferably, the temperature across the hot face does not vary by more than 50° C.

The plurality of elements may be present throughout substantially all of the wall lining in order to achieve the desired uniform temperature across the hot face. Alternatively, the plurality of elements may be arranged in the wall linings such that they are more concentrated in what would otherwise be hot spots in the furnace. Similarly, cooler parts of the furnace may have a relatively lesser number of elements and it is possible that the elements may not extend to all parts of the furnace. This is especially so in cases where furnace design and operation would, in the absence of the plurality of elements, lead to pronounced hot and cold spots in the furnace, it being appreciated that the further heat extraction provided by the plurality of elements may not be required in cooler areas of the furnace.

The furnace lining of the present invention may be used to ensure that a substantially uniform temperature is attained across the hot face of the furnace in the vicinity of the elements. Alternatively, the lining may be designed to ensure that a substantially uniform temperature is attained across the entire hot face of the furnace. This is preferable as undesirable temperature gradients will be prevented from being formed on the hot face. In either case, the substantially uniform temperature may be below a temperature at which the rate of destruction and/or erosion of the refractory lining will occur at an unacceptably high rate. It will be appreciated that in furnaces that, in the absence of the plurality of elements, would have pronounced hot and cold spots, the elements may only be required in or near what would otherwise be the hot spots.

Preferably, the high thermal conductivity material is a metal or metal alloy. Copper is especially preferred.

In a preferred embodiment of the present invention, the plurality of elements of high thermal conductivity material extend into the refractory lining towards the hot face but are not sufficiently long to extend to the hot face. This results in the ends of the elements being separated from the hot face by a refractory layer, which reduces the heat flux through the wall and acts to insulate the elements from the very high temperatures experienced at the hot face during operation of the furnace. This protects the elements and reduces the possibility of degration of and thermal damage to the elements.

The plurality of elements of high thermal conductivity material extend from the inner wall of the outer shell of the furnace and into the refractory lining to provide a continuous heat conduction path from the ends of the elements close to the hot face to the outer shell. Heat is conducted along the elements to the outer shell. An external cooling circuit may be associated with the outer shell to remove heat from the furnace wall. Therefore, the plurality of elements assist in removing heat from the furnace and enable the hot face of the refractory lining to be maintained at a temperature that allows a long service life for the refractory lining. The plurality of elements are dispersed through the refractory lining such that the hot face has a substantially uniform temperature in the vicinity of the elements. This avoids the formation of hot spots in the furnace, reduces the formation of thermal stresses in the refractory layer and produces stable conditions at the hot face. In this regard, it is noted that the furnace described in U.S. Pat. No. 3,849,587, which utilises relatively large cooling bodies widely spaced throughout the lining, is incapable of achieving these desirous conditions.

The elements of high thermal conductivity material may be formed as metal wires or metal rods, with cooper being the preferred metal of choice. The rods or wires may range in diameter from parts of a millimeter up to 25 mm. Larger diameters are not recommended as it becomes difficult to obtain the desired heat removal from the furnace whilst retaining a substantially uniform temperature across the hot face of the refractory lining.

Alternatively, the elements may be formed by impregnating refractory bricks with molten metal and allowing the molten metal to solidify. When refractory bricks are impregnated with molten metal, the molten metal moves into the bricks along the pores of the refractory bricks. Upon solidification of the molten metal, solid bodies of metal extending from one face of the brick into the brick are formed, and these solid bodies of metal act as the plurality of elements of high thermal conductivity material when the bricks are used to line the furnace. It will be appreciated that the face of the bricks that is exposed to the impregnating molten metal will be the face of the brick that is placed adjacent the inner wall of the outer shell of the furnace. The molten metal should also impregnate only part way through the bricks to ensure that a refractory layer remains between the metal and the hot face of the furnace.

The wall lining of the present invention allows for cooling of the refractory lining without internal cooling of the lining being required. The plurality of elements conducts heat to the outer shell of the furnace and external cooling circuits can remove the heat from the outer shell. The external cooling circuit may be a forced or natural convection air cooling arrangement or, more preferably, be a cooling water circuit. For example, the outer shell may be encased in a water jacket, although other cooling water arrangements may also be used.

The plurality of elements provide a continuous path for heat conduction to the outer shell. They also allow for minimisation of contact resistances to heat transfer from the refractory lining. More effective heat transfer can be achieved than in composite linings described in some prior art documents, because the wall lining of the present invention exhibits a higher overall effective thermal conductivity.

In one embodiment, the plurality of elements may be integrally formed with the outer shell. In another embodiment, the plurality of elements may be attached or affixed to the outer shell.

The wall lining of the present invention may be retrofitted to existing furnaces or it may be designed as part of new furnaces. In the case of retro-fitting existing furnaces, the plurality of elements may be inserted into holes drilled through the furnace and into the refractory lining, although this has the potential to weaken the furnace structure. More preferably, the wall lining is fitted at the same time as replacement of the refractory lining is to occur. The lining may be fitted at such a time by using metal impregnated refractory bricks to line the furnace or by using refractory bricks previously fitted with rods or wires.

In another aspect, the present invention provides a method for lining a furnace with a wall lining comprising a refractory lining having a plurality of elements of high thermal conductivity elements extending from an outer shell of the lining into the refractory lining, said method comprising:

(a) calculating heat flux through the wall lining required to obtain a desired temperature at a hot face of the wall lining;

(b) determining a thickness of the wall lining and a thermal conductivity of the wall lining required to obtain said heat flux calculated in step (a);

(c) determining positioning and spacing of said plurality of elements in said wall lining required to obtain said thermal conductivity; and (d) providing said furnace with said wall lining, said elements being in thermal contact with the outer shell, said wall lining providing a substantially uniform temperature across the hot face of the furnace during operation to said furnace.

The present invention may also enable a furnace to be fitted with a refractory lining without using refractory bricks at all.

In a further aspect, the present invention provides a method for lining a furnace with a refractory lining, said furnace including an outer shell, which method comprises:

fixing an array of elements of a high thermal conductivity material to an inside wall of the outer shell such that the array of elements is in thermal contact with the outer shell, and applying a refractory-containing material to the inside wall of the outer shell to form a coating on the inside wall.

The refractory-containing material may be applied in a substantially dry state or in the form of a slurry or a paste.

The refractory-containing material may include a refractory material and one or more further components that result in a composite refractory lining being obtained, or the refractory-containing material may contain purely refractory material only.

The refractory lining may be a composite lining formed by sequentially applying, in any desired order, separate layers of a refractory-containing material and layers of non-refractory or low refractory materials.

If a slurry or paste of a refractory-containing material is used, it may be necessary to apply the refractory or paste to the inside wall in a series of stages in which a first thin coating is applied and allowed to set, followed by the application of one or more further coatings of slurry or paste. This step-wise building up of the refractory lining may be necessary when thick refractory linings are required, it being appreciated that difficulties may be experienced with drying and cracking of a thick lining if it is applied as a single coat.

The complete refractory lining should be of a thickness that is sufficient to fully cover the array of elements. This will provide a layer of insulating refractory material between the ends of the elements and the hot face of the furnace which will act to prevent melting of the elements during use of the furnace.

The refractory-containing material may be applied to the inside wall by any suitable method known to those skilled in the art. For example, the refractory-containing material may be applied by spraying, gunning or trowelling. The invention should be understood to include all methods of applying the refractory-containing material to the inside wall of the furnace.

If a slurry or paste is used, the slurry or paste should be sufficiently thick or viscous to enable it to remain in place on the inside wall whilst it is setting. Routine trials will easily establish the required slurry or paste viscosity to achieve this aim.

The array of elements preferably comprises an array of metallic elements. In one embodiment, the array of elements comprises a copper wire mesh having further copper wires mounted at the points of intersection on the mesh and extending substantially at right angles to the plane of the mesh. When the mesh is fixed to the inside wall of the shell of the furnace, the copper wires mounted on the mesh extend generally inwardly into the furnace. In use of the furnace, these copper wires act as cooling elements that provide a continuous heat conduction path from the end of the wires to a source of external coolant that is in contact with the outer shell and the cooling elements thereby assist in removing heat from the furnace.

In another embodiment, the step of fixing the array of elements to the inside wall of the outer shell comprises integrally forming the array of elements with the inside wall of the outer shell. The array of elements may alternatively be formed by casting molten metal onto the inside wall of the outer shell.

Preferably, the array of elements is arranged such that a substantially uniform temperature is achieved across the hot face of the furnace in the vicinity of the elements during operation of the furnace.

If a substantially uniform temperature across the entire hot face of the refractory lining of the furnace is desired or required, it may be necessary to have an uneven distribution of elements of high thermal conductivity material throughout the wall lining. For example, the number of elements located at known hot spots of an operating furnace may be increased to remove proportionally greater amounts of heat per square meter when compared to cooler areas of the furnace.

BRIEF DESCRIPTION OF THE DRAWING

Preferred embodiments of the present invention will be described in greater detail with reference to the Figures, in which.

DETAILED DESCRIPTION OF THE PREFERRED EMBODIMENTS

Figure 1:
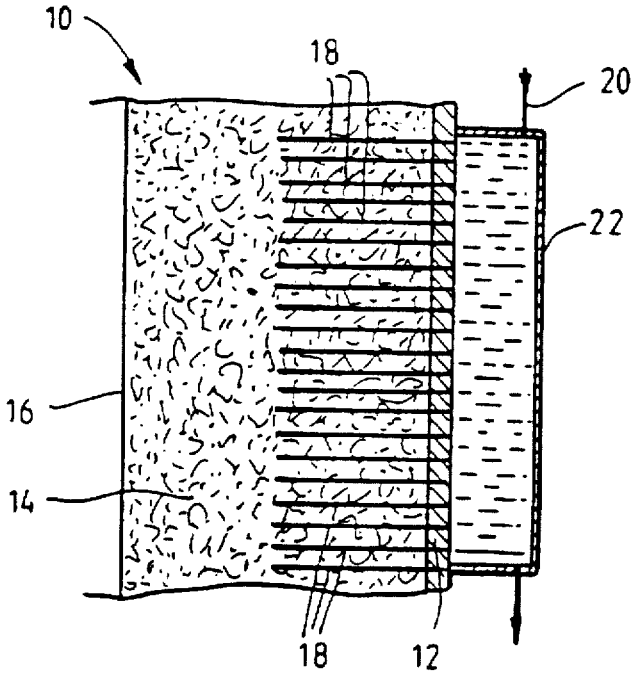
FIG. 1 shows a cross-section of a wall lining of a furnace in accordance with the present invention.

Referring to FIG. 1, the wall 10 of the furnace includes outer shell 12. The outer shell is generally made of steel. The furnace includes refractory lining 14. Hot face 16 is exposed to the intense temperatures generated within the furnace. The wall lining includes a plurality of copper rods or wires 18 in thermal contact with the outer shell 12 and extending into refractory lining 14. As can be seen from FIG. 1, copper rods 18 do not extend right through refractory lining 14 but rather end some distance away from the hot face 16. This ensures that there is a layer of refractory material located between the ends of copper rods 18 and the hot face 16 and this layer of refractory material insulates the rods from the high temperature in the furnace, thereby preventing degradation of and thermal damage to the rods.

Figure 7:
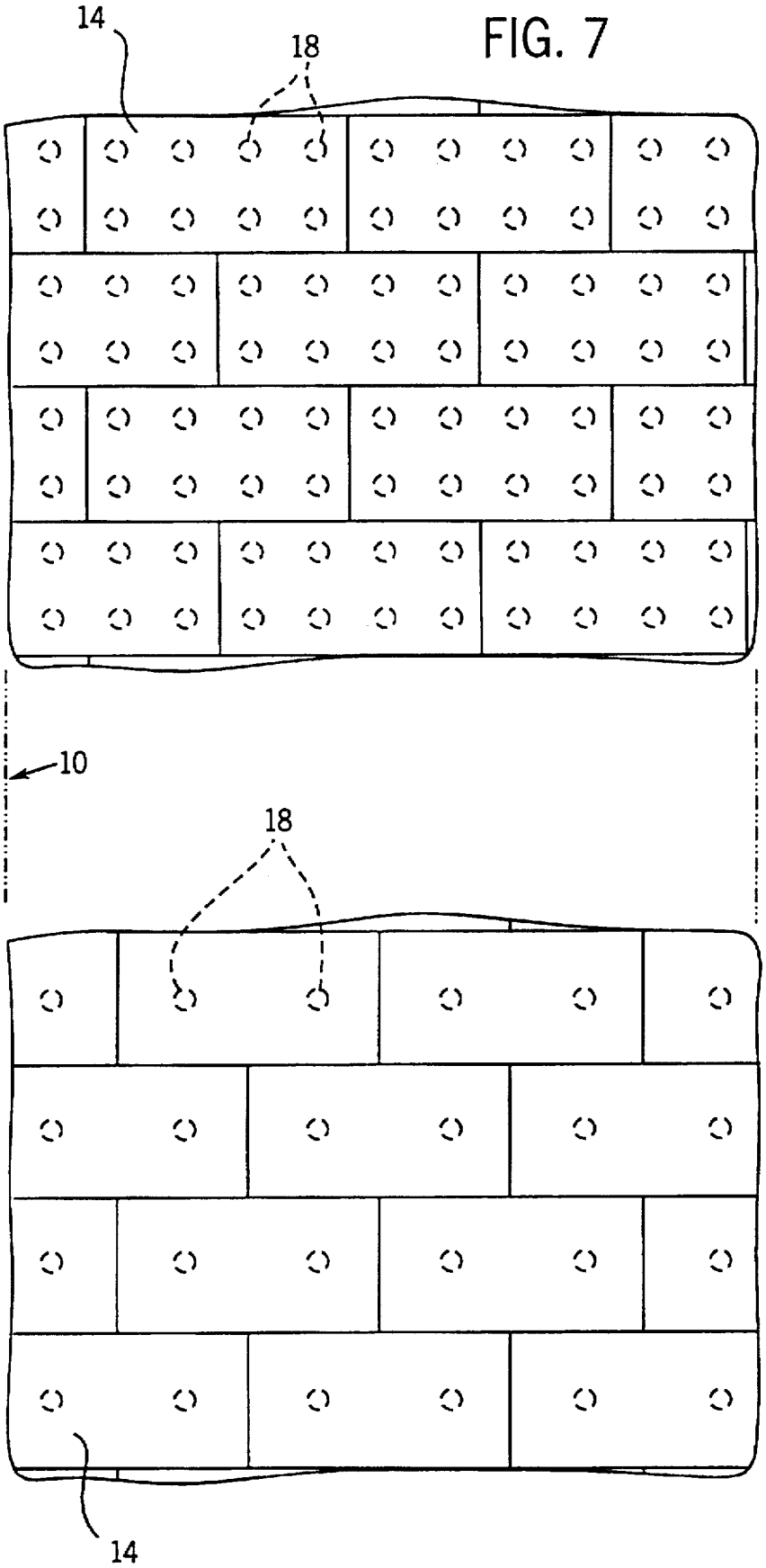
FIG. 7 is a partial view of the hot face of the furnace.

The plurality of elements 18 are arranged such that the elements are relatively concentrated in hot spots in the furnace and a relatively lesser number of elements are located in the cooler parts of the furnace, as shown in FIG. 7.

During operation of the furnace, heat is transferred from hot face 16 through refractory lining 14 and to copper rods 18. The rods are in thermal contact with outer shell 12 and act to rapidly transfer heat to the shell. Cooling water 20, which flows through cooling jacket 22, subsequently removes heat from the shell.

The copper rods 18 are dispersed through the refractory lining to provide a substantially uniform thermal gradient across the hot face. The rods are preferably arranged such that essentially one-dimensional heat transfer through the wall is produced. This cools the hot face very evenly, effectively eliminating wall hot spots evident with prior art designs that cause uneven wear of the hot face. One-dimensional heat transfer has also been shown to be more efficient i.e. less high conductivity material is required to remove the same heat flux.

The purpose of the wall lining is to reduce the refractory temperature at the hot face to a specified temperature (either that at which corrosion reactions cease or freezing of process material occurs). The cooler must be designed so as to achieve this while minimising furnace heat losses (heat flux through the wall). The heat flux Q ($W/m^2$), through the wall in FIG. 1 can be calculated by the following formula where $T_f$ is the furnace temperature °C.), $T_c$ is the coolant temperature °C.), and $R_{TOT}$ is the total thermal resistance of the wall section ($m^2$ K/W).

$$Q = \frac{T_f - T_c}{R_{TOT}}$$

Therefore to control the refractory temperatures and heat flux the thermal resistance of the wall section must be altered. The total thermal resistance is the sum of the conduction resistance of each material layer and the convection resistance at the hot and cold faces. However the convection resistances are either unchangeable or insignificant so the heat flow can only be controlled by the value of the conduction resistance of the actual element. A thermal conduction resistance $R_{COND}$ ($m^2K/W$), is given as $$R_{COND} = \frac{L}{\lambda}$$

where L the thickness of the layer (m), and is λ is the thermal conductivity of the material (W/mK), changing the conductivity and thickness of the material layers in FIG. 1 then allows the refractory temperatures and the heat flux to be controlled. The temperature profile throughout the wall section can be easily calculated by separate consideration of each thermal resistance using Equation 1. As mentioned previously the element is most efficient and the design procedure is most accurate when a uniform high conductivity material layer is employed as one-dimensional heat transfer is produced. However the method can still be applied to non-homogeneous wall layers with reasonable accuracy.

Figure 2:
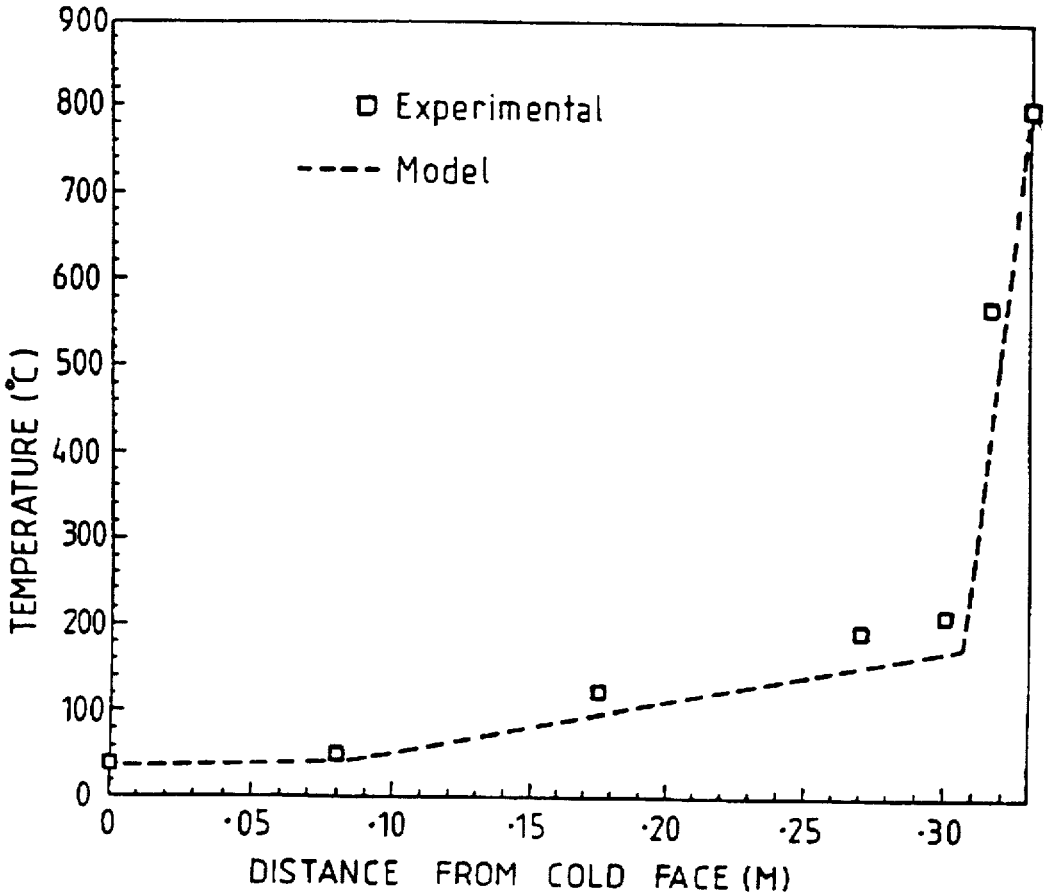
FIG. 2 shows a plot of temperature profile through the wall lining.

A thermal resistance model, based on the above procedure, has been used in an experimental study to predict the temperature distribution through a refractory cooler of the form shown in FIG. 1. The experimental and model results are shows in FIG. 2 for the case where the copper rods are 20 mm in diameter and 60 mm apart. The model produces a reasonably accurate prediction of the temperature profile and heat flux (experimented 24.0 $kw/m^2$, model 21.2 $kw/m^2$), thereby showing the validity of this approach for element design.

Therefore, the present invention also provides for a relatively simple yet rigorous design procedure that is not available with prior art designs.

Figure 3:
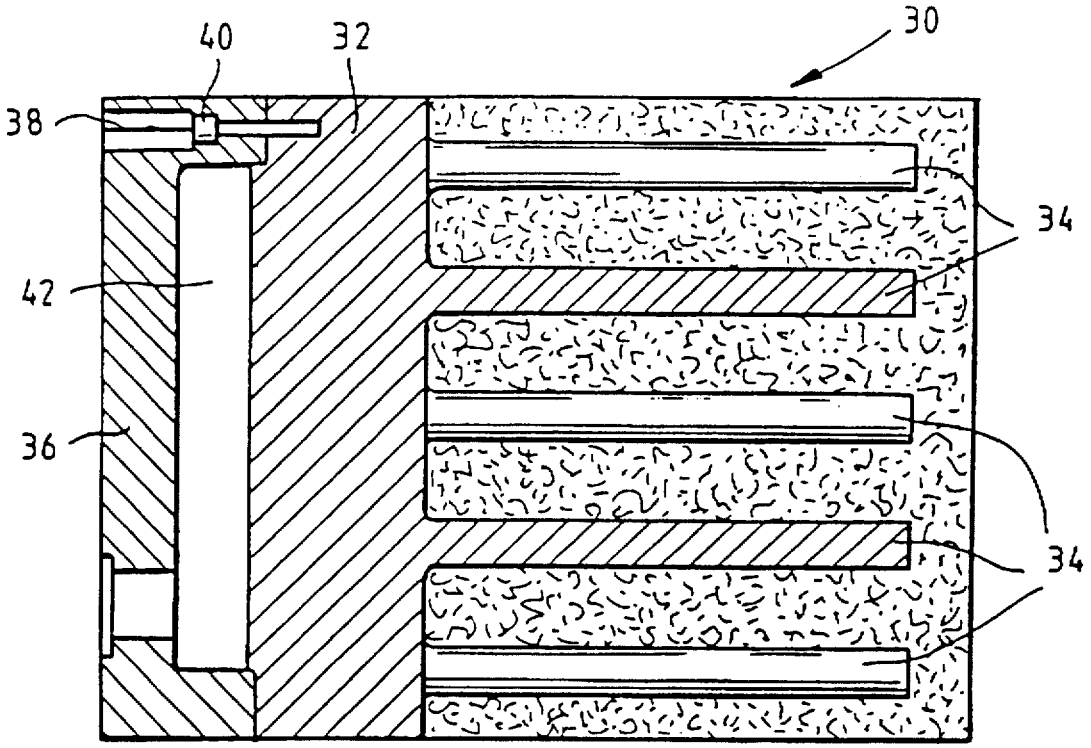
FIG. 3 is a cross-sectional view of a cooling element design in accordance with the present invention.

FIG. 3 shows a cross-section of a cooling element 30 in accordance with the invention. The element consists of a copper base plate 32 integrally cast with copper rods 34 to form the main element body. An external water jacket 36 is bolted to the base plate 32, for example, by cap screws 38. A polytetrafluoroethylene gasket 40 is used to provide a fluid-tight seal between base plate 32 and water jacket 36 and to prevent water leaks from water flow passage 42. Refractory 44 is cast around rods 34 to form the wall. As can be seen from FIG. 3, refractory 44 extends from base plate 32 to slightly beyond the ends of copper rods 34.

The main features of this cooling element design are the external water jacket, closely spaced copper rods and the use of castable refractory to form the wall. The external water jacket effectively eliminates the possibility of damaging water leaks into the furnace. The small pitch between adjacent copper rods (60 mm) should greatly reduce the temperature gradients perpendicular to the hot face which are evident with conventional cooling elements. This should result in a much more evenly cooled wall which will in turn produce more even wear of the hot face. The use of castable refractory should reduce the thermal resistances due to air gaps that commonly occur between refractory bricks. All these factors should contribute to a more efficient cooling system.

Figure 4:
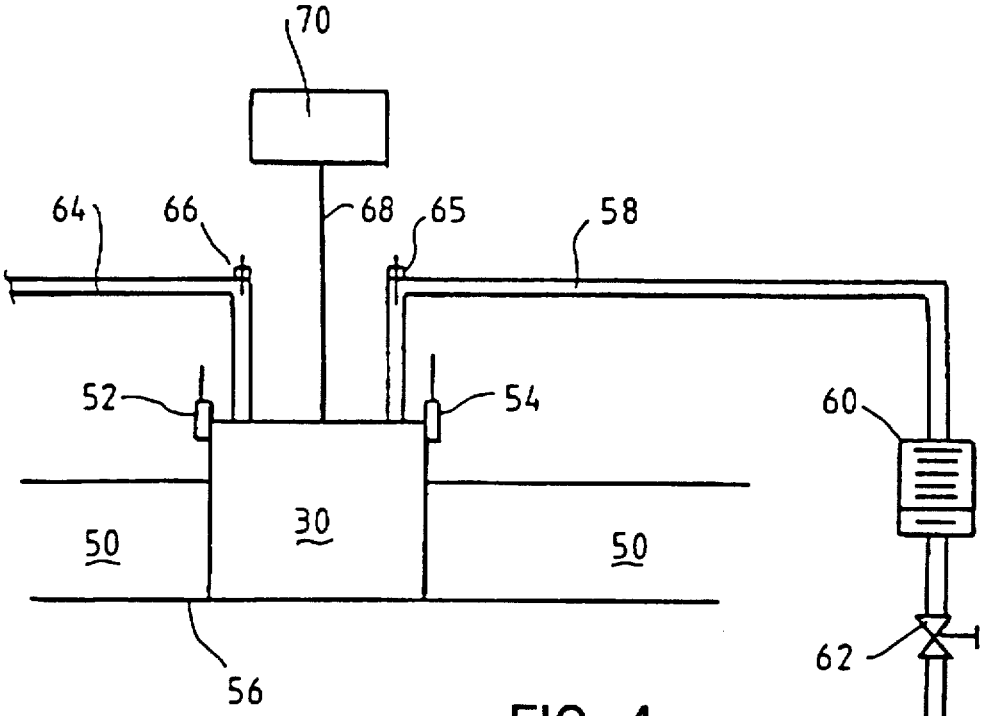
FIG. 4 is a schematic diagram showing the set-up used for a plant trial incorporating the cooling element design of FIG. 3.

Plant trials of the cooling element design were undertaken using the cooling element shown in FIG. 3. The set-up used in the plant trials is shown in FIG. 4. Cooling element 30 was installed in the settler roof 50 of the furnace. The roof is exposed to the mildest furnace conditions (i.e. relatively low temperatures and no slag washing) and was thought to be most suitable for this trial. The cooling element 30 was suspended from supporting beams (not shown) by support brackets 52, 54 and the face of the cooling element was positioned flush with the hot face 56 of the furnace. The cooling element 30 was fitted with water inlet 58 that included rotameter 60 for measuring the water flow rate and valve 62 for controlling the water flowrate. Cooling water is removed from the cooling element via cooling water outlet line 64. Type K immersion thermocouples 65,66 were connected to the water jacket to measure inlet and outlet water temperature, respectively. Twenty-four thermocouples were placed within cooling element 30 to measure the temperature profile within the cooling element. Output from these thermocouples (shown schematically at 68) was connected to a datalogger 70 which logged readings every five minutes.

Figure 5:
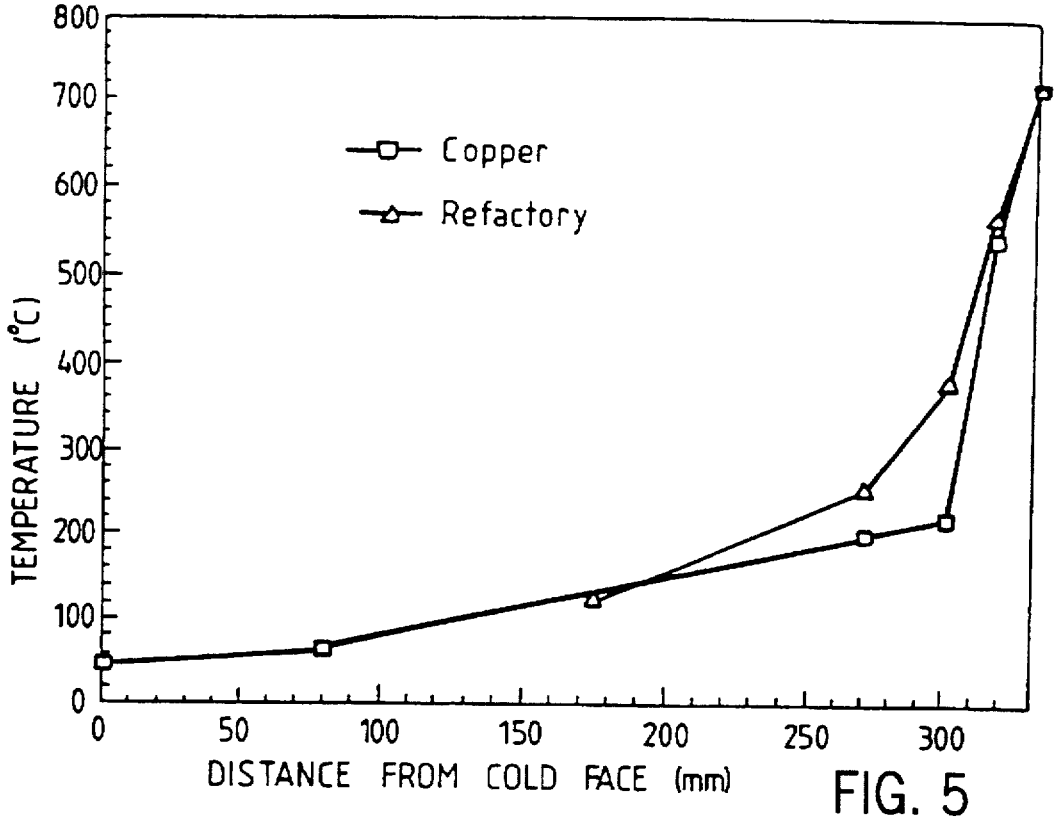
FIG. 5 is a plot of the temperature profile through the cooling element from the plant trial.

The new cooling element was found to operate successfully in the plant trials. FIG. 5 shows a sample temperature profile through the element from the hot face to the cold face recorded during a period of steady furnace operation. There are two separate profiles (copper and refractory) shown on FIG. 5. The copper profile is taken from the cold face, passing through the center of a copper rod into the refractory past the tip of the rod to the hot face. The refractory profile runs through the refractory, midway between adjacent rods, to the hot face. There is a very low temperature gradient, 0.2° C./mm, through the solid copper plate (0 to 80 mm). The temperature gradient increases to 0.7° C./mm through the copper rod (80 to 300 mm). This is still a relatively low gradient with the tip of the rod only reaching 216° C. The low temperature at the rod tip shows that the external water jacket was able to effectively cool the internal copper rods. The temperature gradient through the rods is linear showing that heat transfer is largely one-dimensional along the rods. In the refractory adjacent to the rods the temperatures are similar to the copper temperatures up to a distance of about 25 mm from the cold face. However, towards the tips of the copper rods (225 to 305 mm from the cold face), the refractory temperatures are significantly higher than the copper temperatures at the same depth. This indicates the presence of multi-dimensional heat transfer and temperature gradients in the element between the copper and refractory. These gradients are due to the uneven cooling (not one-dimensional) that occurs at the rod tips because of the large difference in conductivity between the copper and refractory. It is desirable to minimise these uneven temperature gradients as higher refractory temperatures can cause increased wear, as discussed previously. However, the temperatures throughout the remainder of the element section, and most importantly on the hot face, are reasonably similar from both profiles. This shows the new element design is effective in cooling the wall fairly evenly in all areas apart from the zone around the rod tips.

The temperature gradient through the refractory from the tip of the copper rod to the hot face (305 to 330 mm) in FIG. 5 is much higher than through the copper rods and refractory (80 to 305 mm). This gradient is approximately linear and ranges from 11° C./mm for the refractory between the copper rods to 17° C./mm for the refractory along the line of the copper rod with the hot face reaching a temperature of 752° C. The high temperature gradient near the hot face shows the large insulating effect that a small thickness (25 mm) of refractory has due to its low conductivity. This layer of refractory on the hot face protects the copper rods from the high furnace temperatures and limits the heat flux through the element.

Figure 6:
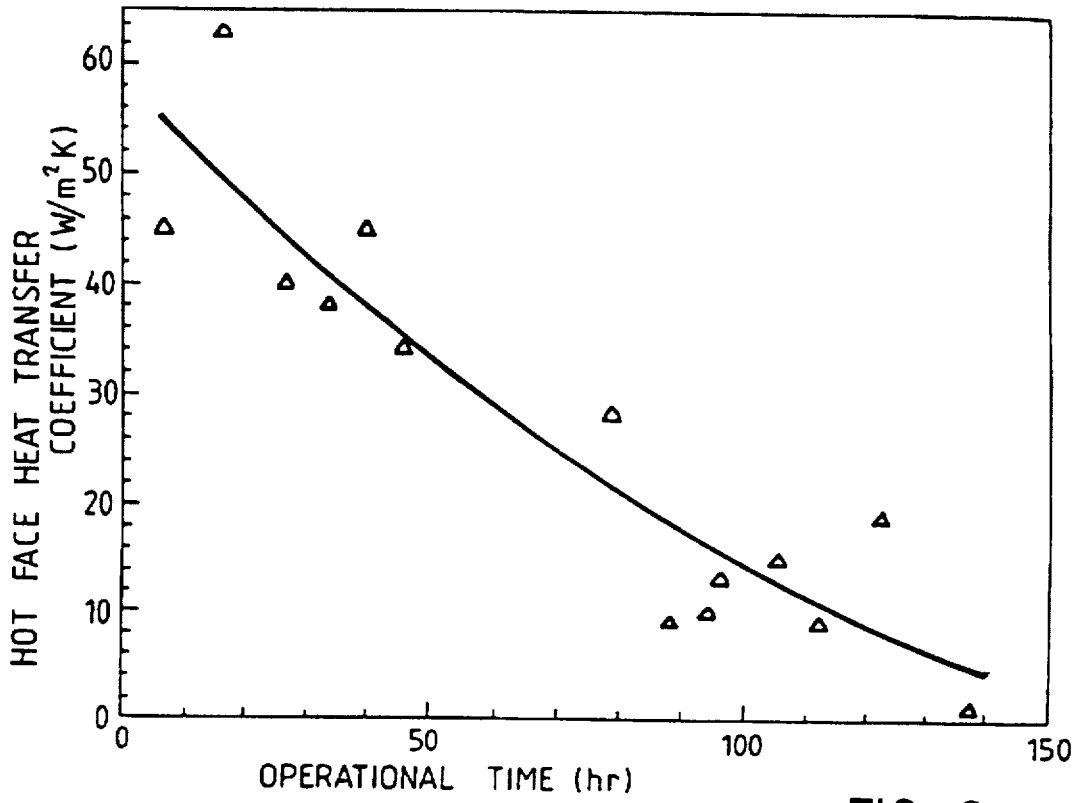
FIG. 6 is a plot of the variation, with time, of the hot face heat transfer coefficient during the plant trial.

An accretion layer of frozen process material built up on the hot face of the cooling element during the plant trial. The accretion layer introduced an addition thermal resistance which reduced the heat removed by the cooling water significantly. The hot face heat transfer coefficient was similarly affected (as shown in FIG. 6) because the thermal resistance of the accretion was incorporated into the calculated heat transfer coefficient. Some of the variation displayed in FIG. 6 is due to irregular furnace operation and the transient nature of the accretion layer; however, the effects of the accretion build-up can clearly be seen by the gradual decrease in the heat transfer coefficient. The heat transfer coefficient fell from an initial value of around 50 to 60 $W/m^2K$ to virtually zero. The hot face temperature (at the end of the element) was also reduced from 700° C. to under 100° C. due to the insulating effect of the accretion layer. The thickness of the accretion layer was estimated to be 250 mm by pushing a large Type-K thermocouple down beside the element and through the accretion. The extent and stability of any accretion layer depends not only on the extent of cooling but also on the internal furnace conditions and process material characteristics. Accretion build-up assists in providing refractory protection.

Those skilled in the art will appreciate that the invention is susceptible to variations and modifications other than those specifically described. It is to be understood that the present invention encompasses all such variations and modifications that fall within its spirit and scope.

We claim:

1. A wall lining for a furnace, the furnace having a hot face exposed to high temperatures during operation of the furnace, the operation of the furnace creating hot spots and cooler portions in the furnace, the furnace having an outer shell and a heat removal means in conjunction with the shell, the heat removal means containing an external coolant, said wall lining providing substantially uniform temperature across the hot face of the furnace in the vicinity of said wall lining, said wall lining comprising a refractory lining adjacent an inner surface of the outer shell, said refractory lining having an inner surface forming the hot face of the furnace, said refractory lining including a plurality of solid elements of a high thermal conductivity material, the elements extending into the refractory lining toward the inner surface thereof, each of the elements providing a continuous heat conduction path between a first end of the element located closer to the inner surface of said refractory lining and a second end located closer to the outer shell of the furnace, the second ends of said solid elements providing a thermal conduction heat transfer path to said heat removal means, the plurality of elements being dispersed and spaced in the refractory lining such that said elements are relatively concentrated in the hot spots in the furnace and a relatively lesser number of elements are located in the cooler parts of the furnace, so that thermal gradients in said wall lining are avoided and a substantially uniform temperature across the hot face of the furnace is provided in the vicinity of said wall lining during operation of the furnace.

2. A wall lining for a furnace as claimed in claim 1 where said refractory lining is adjacent substantially all the inner surface of said outer shell.

3. A wall lining for a furnace as claimed in claim 1 wherein said wall lining is further defined as providing a substantially uniform temperature of a given magnitude at said hot face and wherein said elements are spaced and positioned in said refractory lining to provide a thermal conductivity to said wall lining which, when taken with the thickness of said wall lining, establishes the heat flux through the wall lining necessary to establish the given magnitude substantially uniform temperature at the hot face of the furnace.

4. A wall lining for a furnace as claimed in claim 1 wherein the plurality of elements of a high thermal conductivity material extend into the refractory lining towards the hot face of the furnace but do not extend through the refractory lining.

5. A wall lining for a furnace as claimed in claim 1 wherein the high thermal conductivity material is a metal or a metal alloy.

6. A wall lining for a furnace as claimed in claim 5 wherein said metal or metal alloy is copper.

7. A wall lining for a furnace as claimed in claim 5 wherein the elements of high thermal conductivity material comprise metal wires or metal rods.

8. A wall lining for a furnace as claimed in claim 7 wherein the metal wires or metal rods have a diameter of up to 25 mm.

9. A wall lining for a furnace as claimed in claim 1, wherein said refractory lining is formed of refractory bricks and wherein the elements of high thermal conductivity material are formed by impregnating said refractory bricks with molten metal and allowing the molten metal to solidity.

10. A wall lining for a furnace as claimed in claim 9 wherein the molten metal impregnates only part-way into the refractory bricks.

11. A wall lining for a furnace as claimed in claim 1 wherein the plurality of elements are integrally formed with the outer shell.

12. A wall lining for a furnace as claimed in claim 1 wherein the plurality of elements are attached or affixed to the outer shell.

13. A wall lining for a furnace as claimed in claim 1 wherein the plurality of elements are present throughout substantially all of the wall lining.

14. A wall lining for a furnace as claimed in claim 6 wherein said high thermal conductivity material elements comprise a copper wire mesh proximate the inner surface of said outer shell, said copper wire mesh having further copper wires mounted at points of intersection on the mesh and extending substantially at right angles to the plane of the mesh into the refractory lining.

15. A method for lining a furnace with a wall lining comprising a refractory lining having a plurality of elements of high thermal conductivity elements extending from an outer shell of the lining into the refractory lining, said method comprising the steps of:

(a) calculating heat flux through the wall lining required to obtain a desired temperature at a hot face of the wall lining;

(b) determining a thickness of the wall lining and a thermal conductivity of the wall lining required to obtain said heat flux calculated in step (a);

(c) determining positioning and spacing of said plurality of elements in said wall lining required to obtain said thermal conductivity; and (d) providing said furnace with said wall lining, said elements being in thermal contract with the outer shell, said wall lining providing a substantially uniform temperature across the hot face of the furnace during operation to said furnace.

16. A method as claimed in claim 15 wherein said elements are concentrated in hot spots of said furnace and a relatively lesser number of elements are positioned in cooler parts of said furnace.

17. A method as claimed in claim 15 wherein said heat flux is calculated from the equation:

$$Q = \frac{T_f - T_c}{R_{tot}} = \frac{L}{\lambda}$$

where

Q=heat flux $T_f$=furnace temperature $T_c$=temperature of coolant used to cool the outer shell $R_{Tot}$=total thermal resistance of the wall lining and the total thermal resistance of the wall lining. $R_{Tot}$ is approximated by:

$$R_{Tot} \approx \frac{L}{\lambda}$$

where

L=thickness of the wall lining; and

λ=thermal conductivity of the wall lining.

18. A method as claimed in claim 15 further comprising fixing an array of said elements to an inside wall of the outer shell of the furnace such that the elements are in thermal contact with the inside wall and applying a refractory containing material to the inside wall of the outer shell to form a coating on the inside wall.

19. A method as claimed in claim 18 wherein the refractory lining has a thickness to fully cover the array of elements.

20. A method as claimed in claim 18 wherein the step of fixing the array of elements comprises affixing a copper wire mesh to the inside wall of the outer shell, said copper wire mesh having further copper wires mounted at points of intersection on the mesh and extending substantially at right angles to the plane of the mesh.

* * * * *